US011738430B2

(12) United States Patent
Lai et al.

(10) Patent No.: US 11,738,430 B2
(45) Date of Patent: Aug. 29, 2023

(54) STRIKING DEVICE

(71) Applicant: BASSO INDUSTRY CORP., Taichung (TW)

(72) Inventors: Chun-Chi Lai, Taichung (TW); Liang-Chi Hung, Taichung (TW); Sheng-Man Wang, Taichung (TW); Hung-Da Chen, Taichung (TW); Chia-Yu Chien, Taichung (TW); Jian-Rung Wu, Taichung (TW)

(73) Assignee: Basso Industry Corp., Taichung (TW)

( * ) Notice: Subject to any disclaimer, the term of this patent is extended or adjusted under 35 U.S.C. 154(b) by 217 days.

(21) Appl. No.: 17/076,882

(22) Filed: Oct. 22, 2020

(65) Prior Publication Data

US 2021/0122019 A1 Apr. 29, 2021

(30) Foreign Application Priority Data

Oct. 23, 2019 (TW) ..... 108138274

(51) Int. Cl.
*B25C 1/06* (2006.01)
*B25C 5/15* (2006.01)

(52) U.S. Cl.
CPC . *B25C 1/06* (2013.01); *B25C 5/15* (2013.01)

(58) Field of Classification Search
CPC ..... B25C 1/06; B25C 5/15
See application file for complete search history.

(56) References Cited

U.S. PATENT DOCUMENTS 2,710,963 A * 6/1955 Francis ..... B25C 1/005 227/131
4,573,621 A * 3/1986 Merkator ..... B25C 1/005 227/8
5,009,356 A * 4/1991 Chang ..... B25C 5/1675 227/123

(Continued)

FOREIGN PATENT DOCUMENTS

GB 2582063 A 9/2020
TW 201317091 A1 5/2013

(Continued)

OTHER PUBLICATIONS

Search Report appended to an Office Action, which was issued to UK Application No. GB2016625.2 by the IPO dated Dec. 18, 2020.

(Continued)

*Primary Examiner* — Thomas M Wittenschlaeger
*Assistant Examiner* — Katie L Gerth
(74) *Attorney, Agent, or Firm* — Burris Law, PLLC

(57) ABSTRACT

A striking device includes a swing arm unit, an impact member and two restoring units. Each of the restoring units includes a stationary seat removably connected to the swing arm unit, a moving seat removably and co-movably connected to the impact member, first and second coupling sets, and a resilient member interconnecting the stationary seat and the moving seat to bias the moving seat toward the stationary seat. For each of the restoring units, two portions of the first coupling set are formed respectively on the stationary seat and the swing arm unit and coupled removably with each other, and two portions of the second coupling set are formed respectively on the moving seat and the impact member and coupled removably with each other.

12 Claims, 15 Drawing Sheets

(56) References Cited

U.S. PATENT DOCUMENTS 5,263,626 A * 11/1993 Howard ..... B25C 1/08 227/8
5,655,697 A * 8/1997 Yeh ..... B26F 1/32 227/27
6,076,722 A * 6/2000 Huang ..... B25C 5/1665 227/123
6,273,316 B1 * 8/2001 Losada ..... B25C 1/184 227/18
6,378,288 B1 * 4/2002 Towfighi ..... B25C 1/08 123/263
7,059,509 B2 * 6/2006 Brown ..... A61B 17/0684 227/176.1
7,182,236 B1 * 2/2007 Wen ..... B25C 1/005 227/8
7,520,413 B1 * 4/2009 Cho ..... B25C 5/1665 227/119
7,556,183 B1 * 7/2009 Liang ..... B25C 1/008 227/129
7,721,928 B2 * 5/2010 Chen ..... B25C 1/008 227/119
7,992,469 B2 * 8/2011 Chang ..... B25B 23/045 81/57.37
2003/0121948 A1 * 7/2003 Hsien ..... B25C 5/1689 227/120
2004/0112933 A1 * 6/2004 Lamb ..... B25C 5/1693 227/18
2005/0023320 A1 * 2/2005 Nayrac ..... B25C 1/08 227/8
2005/0121490 A1 * 6/2005 Sun ..... B25C 5/1644 227/120
2006/0266787 A1 * 11/2006 Ura ..... B25C 5/0228 227/131
2007/0194077 A1 * 8/2007 Lee ..... B25C 1/008 227/8
2008/0135596 A1 * 6/2008 Wu ..... B25C 1/008 227/8
2008/0197165 A1 * 8/2008 Chen ..... B25C 1/008 227/8
2009/0206120 A1 * 8/2009 Komazaki ..... B25C 1/08 227/8
2009/0250500 A1 * 10/2009 Brendel ..... B25C 5/15 227/132
2010/0170929 A1 * 7/2010 Chang ..... B25C 1/008 227/8
2010/0187278 A1 * 7/2010 Lin ..... B25C 1/008 227/107
2011/0259938 A1 * 10/2011 Chien ..... B25F 5/006 227/129
2013/0233903 A1 * 9/2013 Brendel ..... B25C 5/15 227/129
2014/0076952 A1 * 3/2014 Garber ..... B25C 1/06 227/129
2014/0326776 A1 * 11/2014 Riedl ..... B25C 1/00 227/146
2015/0251300 A1 * 9/2015 Po ..... B25C 1/06 227/132
2017/0066116 A1 * 3/2017 Garber ..... B25C 1/06
2017/0100828 A1 * 4/2017 Chien ..... B25C 1/06
2017/0129085 A1 * 5/2017 Miyashita ..... B25C 5/15
2018/0050396 A1 * 2/2018 Lai ..... B23B 45/04
2018/0200873 A1 * 7/2018 Chien ..... B25C 1/06
2019/0022841 A1 * 1/2019 Kamimoto ..... B25C 1/047
2019/0224834 A1 * 7/2019 Fairbanks ..... B25C 7/00
2020/0043380 A1 * 2/2020 Huntington ..... G09F 19/228

FOREIGN PATENT DOCUMENTS

TW 201338936 A 10/2013
TW M482482 U 7/2014
TW 201722636 A 7/2017

OTHER PUBLICATIONS

Search Report appended to an Office Action, which was issued to Taiwanese counterpart application No. 108138274 by the TIPO dated Feb. 2, 2023 with an English translation thereof.

* cited by examiner

STRIKING DEVICE

CROSS-REFERENCE TO RELATED APPLICATION

This application claims priority of Taiwanese Invention Patent Application No. 108138274, filed on Oct. 23, 2019.

FIELD

The disclosure relates to a striking device, more particularly to a striking device to be installed in an electric nail gun.

BACKGROUND

Referring to FIGS. 1 and 2, Taiwanese Patent No. TWM482482 discloses a conventional electric nail gun 1 including a main frame 11, a flywheel 12 that is mounted rotatably to the main frame 11 and that is driven by electric power, a swing arm 14 that is pivoted to the main frame 11, an impact member 15 that is mounted to the swing arm 14, a sliding member 16 that is movable relative to the impact member 15, two first resilient members 17 that interconnect the swing arm 14 and the sliding member 16, and a second resilient member 18 that interconnects the sliding member 16 and the impact member 15.

When the impact member 15 is driven by the flywheel 12 to move, the first resilient members 17 are stretched to generate a restoring force. Therefore, the sliding member 16 is drawn by the first resilient members 17 to move relative to the impact member 15 against the biasing action of the second resilient member 18. As a result, the length of the linear deformation of each of the first resilient members 17 is smaller than the travel distance of the impact member 15 so that each of the first resilient members 17 has a relative small extended length. When the impact member 15 is drawn back by the first resilient members 17, the sliding member 16 is biased to move back by the second resilient member 18.

The sliding member 16, the first resilient member 17 and the second resilient member 18 have complicated installation procedures, and the second resilient member 18 is hidden between the sliding member 16, the impact member 15 and the swing arm 14, which makes it difficult to replace. Moreover, movement of the sliding member 16 may also affect the extended length of the first resilient members 17 undesirably.

SUMMARY

Therefore, the object of the disclosure is to provide a striking device that can alleviate the drawbacks of the prior art.

According to the disclosure, a striking device is adapted to be installed in an electric nail gun. The electric nail gun includes a main frame and a flywheel rotatably mounted to the main frame. The striking device includes a swing arm unit, an impact member, and two restoring units.

The swing arm unit is adapted to be pivotally mounted to the main frame and adapted to swing relative to the flywheel.

The impact member is slidably connected to the swing arm unit and adapted to be driven by the flywheel to move in a length direction.

Each of the restoring units includes a stationary seat removably connected to the swing arm unit, a moving seat removably and co-movably connected to the impact member, first and second coupling sets, and a resilient member interconnecting the stationary seat and the moving seat to bias the moving seat toward the stationary seat.

For each of the restoring units, the first coupling set includes at least one first matching portion formed on one of the stationary seat and the swing arm unit, and at least one first coupling portion formed on the other one of the stationary seat and the swing arm unit and coupled removably with the at least one first matching portion.

For each of the restoring units, the second coupling set includes at least one second matching portion formed on one of the impact member and the moving seat, and at least one second coupling portion formed on the other one of the impact member and the moving seat and coupled removably and co-movably with the at least one second matching portion.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
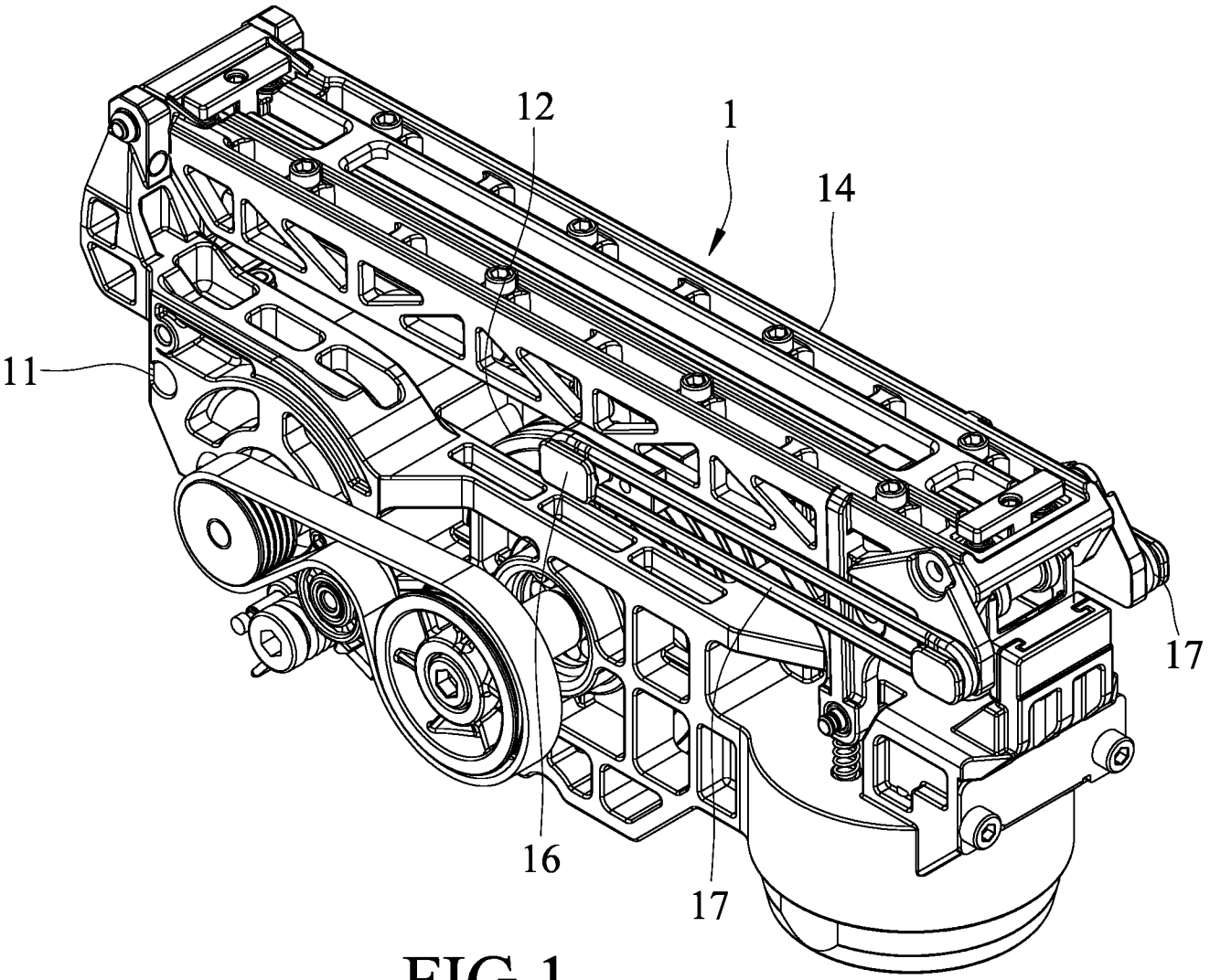
FIG.1 PRIOR ART
FIG. 1 is a perspective view of a conventional electric nail gun disclosed by Taiwanese Patent No. TWM482482.
Figure 2:
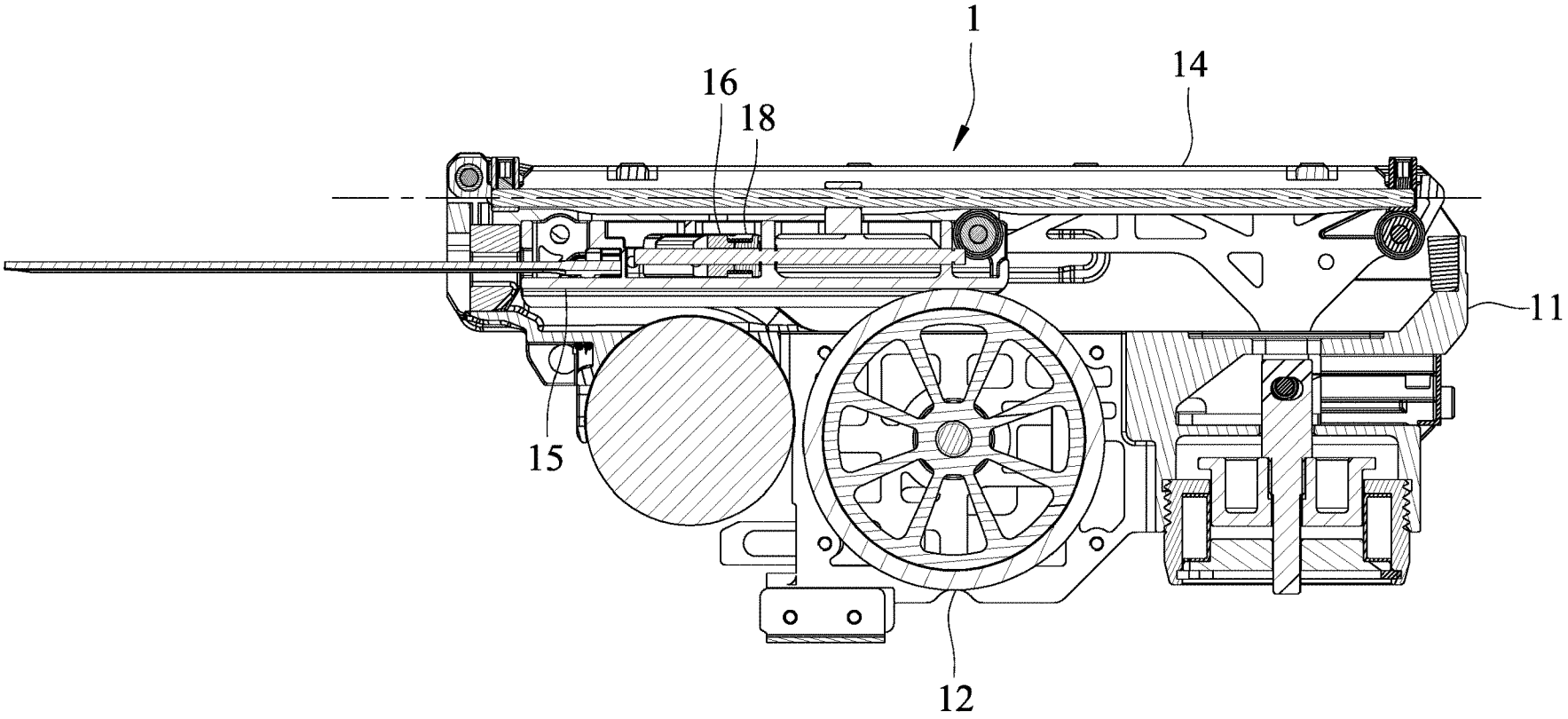
FIG.2 PRIOR ART
FIG. 2 is a sectional view of the conventional electric nail gun disclosed by Taiwanese Patent No. TWM482482.

Before the present invention is described in greater detail, it should be noted that where considered appropriate, reference numerals or terminal portions of reference numerals have been repeated among the figures to indicate corresponding or analogous elements, which may optionally have similar characteristics.

Figure 3:
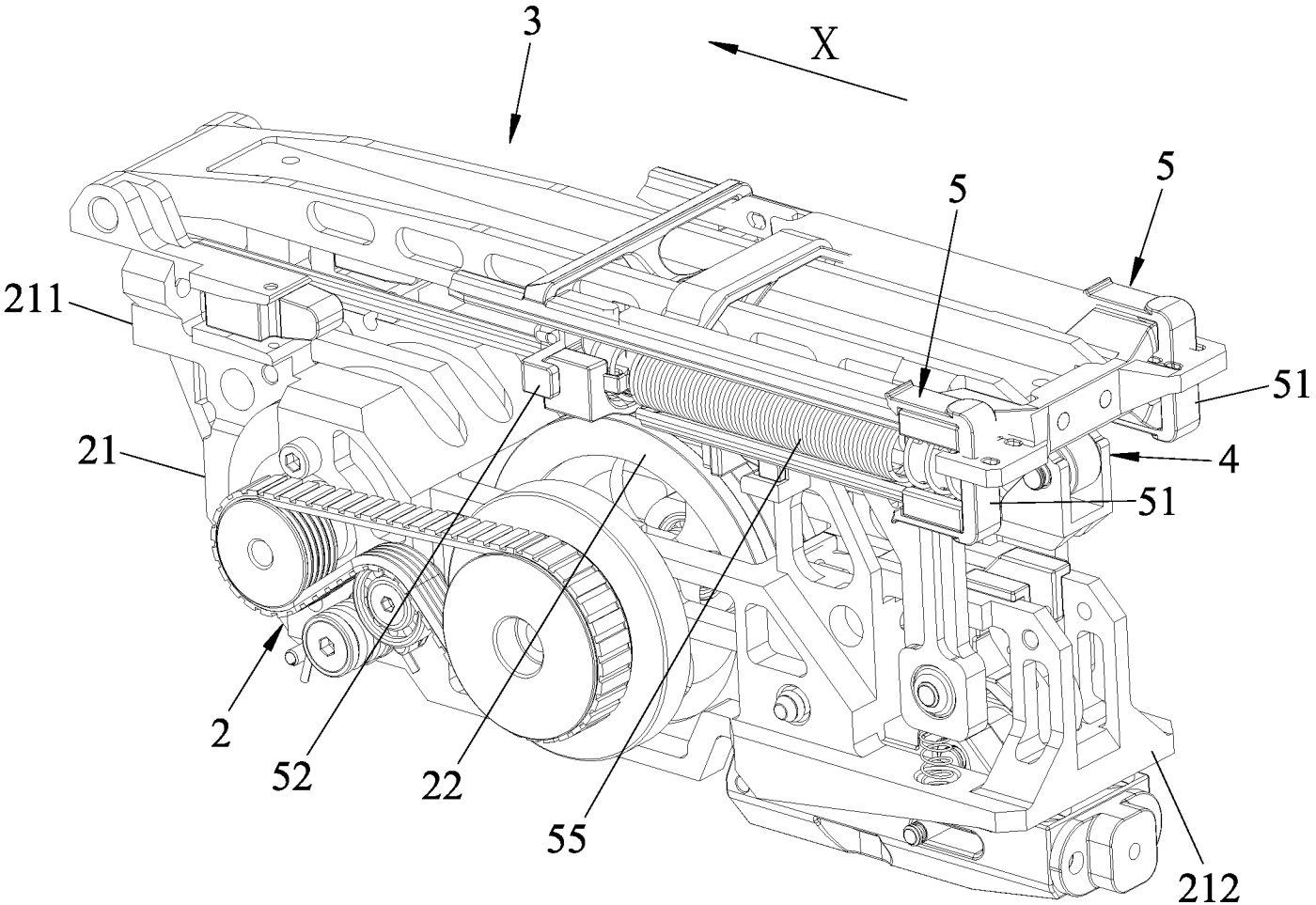
FIG. 3 is a perspective view of a first embodiment of a striking device according to the disclosure installed on an electric nail gun.
Figure 4:
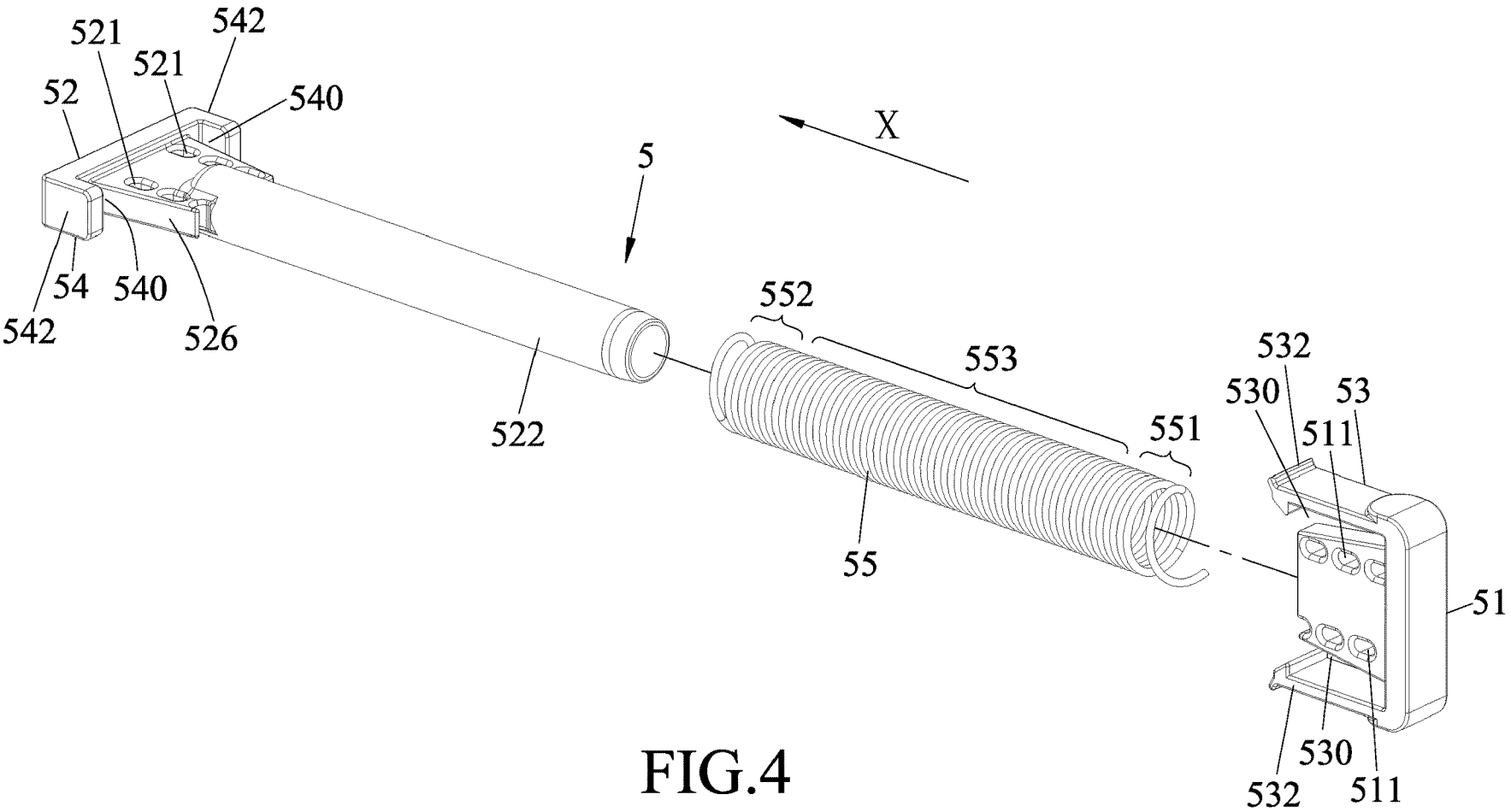
FIG. 4 is an exploded perspective view of a restoring unit of the first embodiment.
Figure 5:
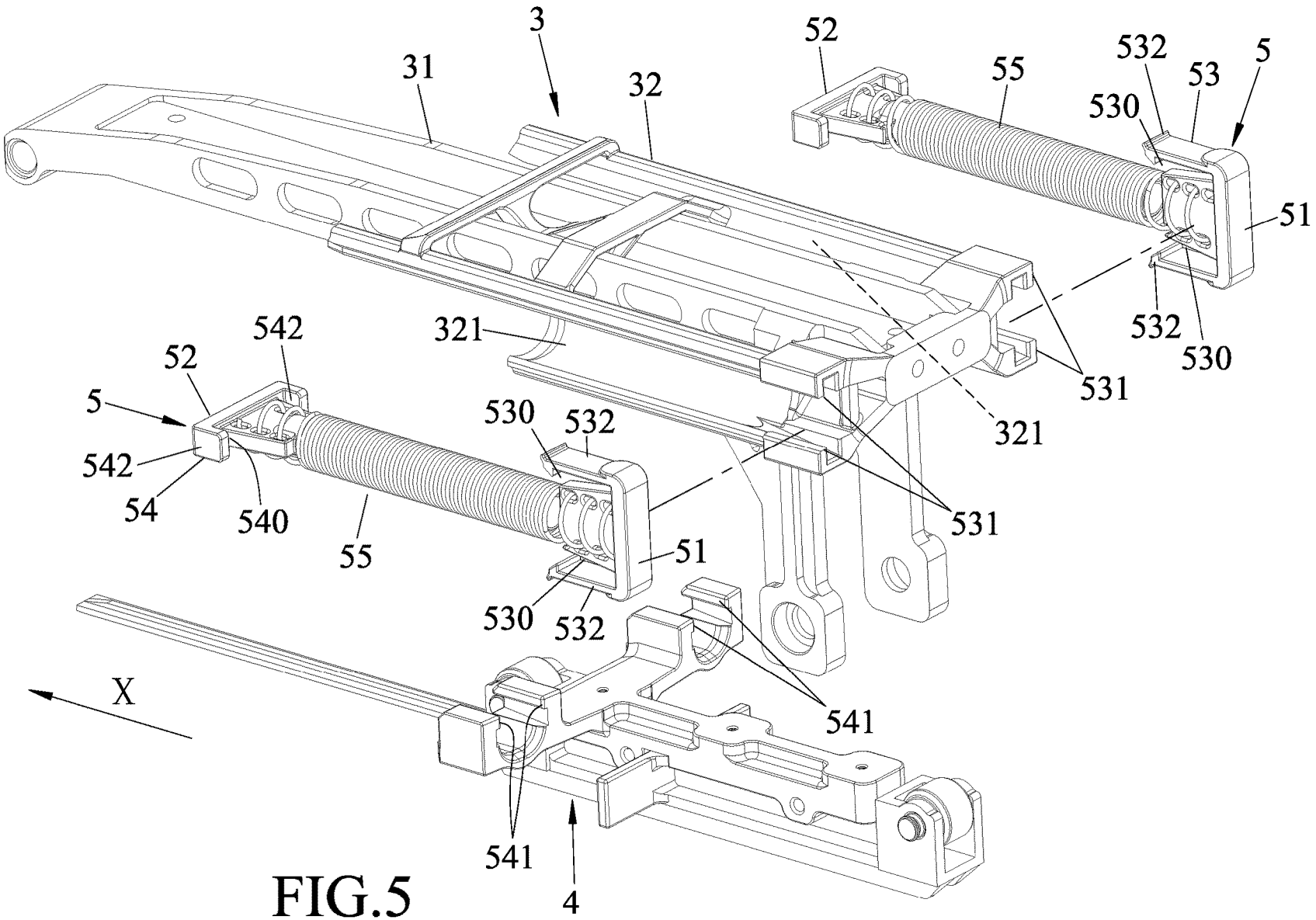
FIG. 5 is is a partly exploded perspective view of the first embodiment.

Referring to FIGS. 3, 4 and 5, a first embodiment of a striking device according to the present disclosure is adapted to be installed in an electric nail gun 2. The electric nail gun 2 includes a main frame 21 and a flywheel 22 that is mounted to the main frame 21 and that can be electrically driven to rotate. The main frame 21 includes a front end portion 211 and a rear end portion 212 that are opposite to each other in a length direction (X). The striking device includes a swing arm unit 3, an impact member 4, and two restoring units 5.

The swing arm unit 3 includes a swing arm 31 adapted to be pivotally mounted to the main frame 21 and configured to swing relative to the flywheel 22, and a loading frame 32 mounted to the swing arm 31 and having two receiving grooves 321 that are disposed respectively on opposite lateral sides thereof and that open outward.

The impact member 4 is slidably connected to the swing arm unit 3 and is adapted to be driven by the flywheel 22 to move in the length direction (X) after coming into contact with the flywheel 22 when a distance between the swing arm 31 and the flywheel 22 is reduced. The impact member 4 is movable relative to the main frame 21 in the length direction (X) from a standby position (FIGS. 6, 8) to an impact position (FIG. 9). In the standby position, the impact member 4 is adapted to be proximal to the rear end portion 212 of the main frame 21. In the impact position, the impact member 4 is distal from the rear end portion 212 of the main frame 21.

As structures of the restoring units 5 are identical, only one of the restoring units 5 is referred to in the following description for the sake of brevity.

The restoring unit 5 includes a stationary seat 51 removably connected to the swing arm unit 3, a moving seat 52 removably and co-movably connected to the impact member 4, first and second coupling sets 53, 54, and a resilient member 55.

The stationary seat 51 has a plurality of stationary elongated holes 511 that are elongated in the length direction (X). In this embodiment, the stationary seat 51 has five stationary elongated holes 511 that are arranged into two non-collinear rows each extending in the length direction (X).

The moving seat 52 includes a main portion 526 formed with a plurality of moving elongated holes 521 that are elongated in the length direction (X), and a guiding portion 522 connected to the main portion 526 and being elongated in the length direction (X). In this embodiment, the moving seat 52 has five moving elongated holes 521 that are arranged into two non-collinear rows each extending in the length direction (X).

The first coupling set 53 includes at least one first matching portion 531 formed on one of the stationary seat 51 and the loading frame 32 of the swing arm unit 3, and at least one first coupling portion 532 formed on the other one of the stationary seat 51 and the loading frame 32 of the swing arm unit 3, and coupled removably with the at least one first matching portion 531. In this embodiment, the at least one first matching portion 531 has two first matching portions 531 formed on the swing arm unit 3 and spaced apart from each other, and the at least one first coupling portion 532 has two first coupling portions 532 disposed respectively on two sides of the stationary seat 51. Each of the first coupling portions 532 cooperatively defines with the stationary seat 51 a first matching space 530 opening toward the moving seat 52 and engaged with a respective one of the first matching portions 531. Each first matching space 530 has a width which increases in the length direction (X) toward the moving seat 52. Each of the first coupling portions 532 is deformable outward to expand a respective one of the first matching spaces 530.

The second coupling set 54 includes at least one second matching portion 541 formed on one of the impact member 4 and the moving seat 52, and at least one second coupling portion 542 formed on the other one of the impact member 4 and the moving seat 52 and coupled removably and co-movably with the at least one second matching portion 541. In this embodiment, the at least one second matching portion 541 has two second matching portions 541 formed on the impact member 4 and spaced apart from each other, and the at least one second coupling portion 542 has two second coupling portions 542 disposed respectively on two sides of the main portion 526 of the moving seat 52. Each of the second coupling portions 542 defines cooperatively with the main portion 526 of the moving seat 52 a second matching space 540 that opens toward the stationary seat 51 and that is engaged with a respective one of the second matching portions 541. Each second matching space 540 has a width which decreases in the length direction (X) away from the stationary seat 51. Each of the second coupling portions 542 is deformable outward to expand a respective one of the second matching spaces 540.

The resilient member 55 is received in a respective one of the receiving grooves 321 of the loading frame 32, extends in the length direction (X), and interconnects the stationary seat 51 and the moving seat 52 to bias the moving seat 52 toward the stationary seat 51, thereby biasing the impact member 4 toward the standby position. The resilient member 55 has opposite first and second end coils 551, 552, and intermediate coils 553 interconnecting the first and second end coils 551, 552 and sleeved on the guiding portion 522 of the moving seat 52. The first end coils 551 extend movably through the stationary elongated holes 511 of the stationary seat 51, and the second end coils 552 extend movably through the moving elongated holes 521 of the moving seat 52.

It should be noted that the resilient member 55 is an extension coil spring, and is made by coiling multiple strands of steel into a steel wire, then forming the steel wire into a helical shape to form the first and second end coils 551, 552 and the intermediate coils 553.

To assemble the striking device, first the first and second end coils 551, 552 are extended correspondingly through the stationary and moving elongated holes 511, 521. Then, the stationary seat 51 is placed to the rear of the first matching portions 531 so that openings of the first matching spaces 530 respectively face the first matching portions 531, and pushed in the length direction (X) to force the first matching portions 531 into the first matching spaces 530 to engage the first matching spaces 530, respectively, and to couple the first matching portions 531 with the first coupling portions 532, respectively. Next, the moving seat 52 is placed in front of the second matching portions 541 so that openings of the second matching spaces 540 respectively face the second matching portions 541, and pushed against the length direction (X) so that the second matching portions 541 respectively engage the second matching spaces 540 and so that the second matching portions 541 are respectively coupled with the second coupling portions 542. In this state, the main body 526 of the moving seat 52 is disposed between the second matching portions 541, and the resilient member 55 and the guiding portion 522 of the moving seat 52 extend in the length direction (X) in the respective one of the receiving grooves 321 of the loading frame 32.

To disassemble the striking device, one only need to deform the first and second coupling portions 532, 542 outward to release the first and second matching portions 531, 541 from engagement, then the stationary seat 51 and the moving seat 52 may be detached from the loading frame 32 and the impact member 4, respectively, for repair or to replace the resilient member 55.

Figure 6:
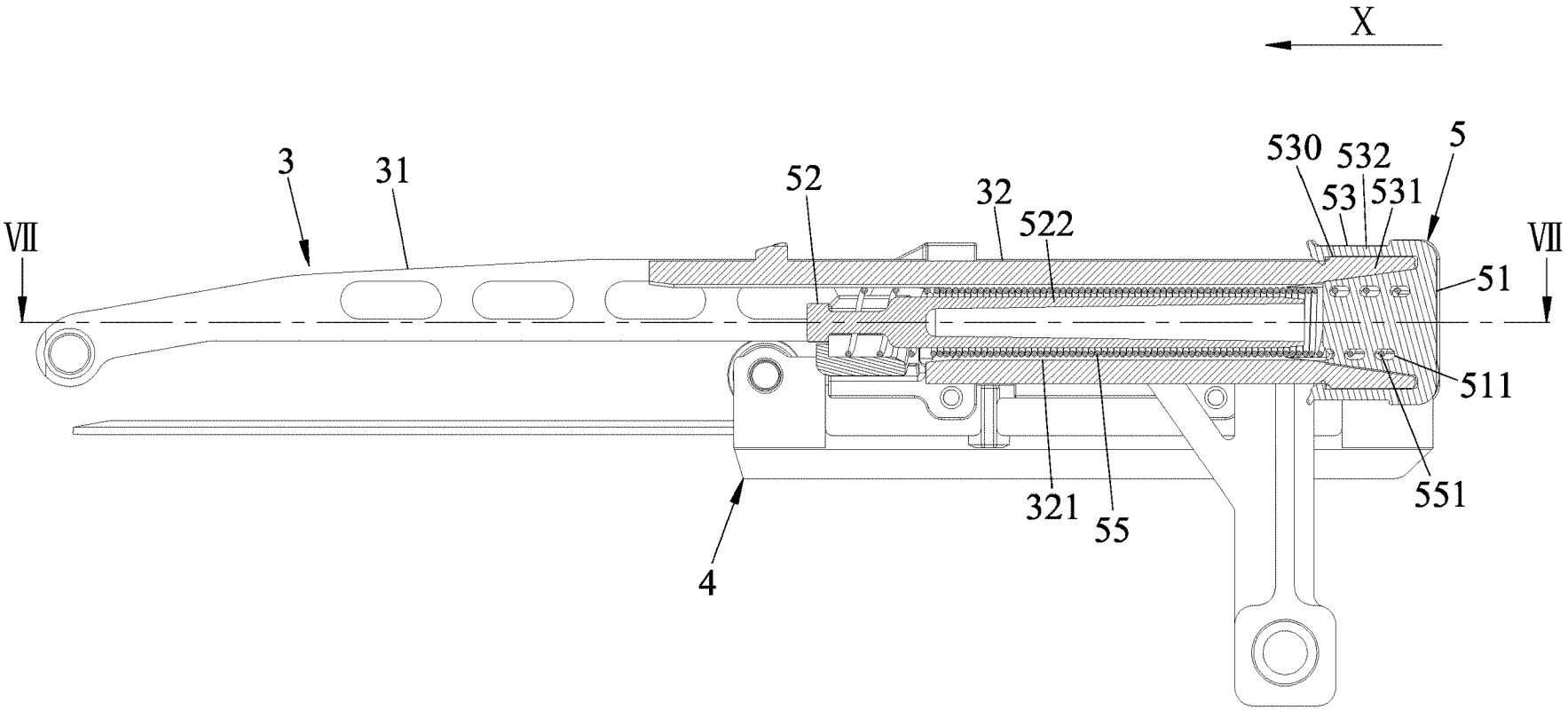
FIG. 6 is a sectional view, illustrating an impact member of the first embodiment at a standby position.
Figure 7:
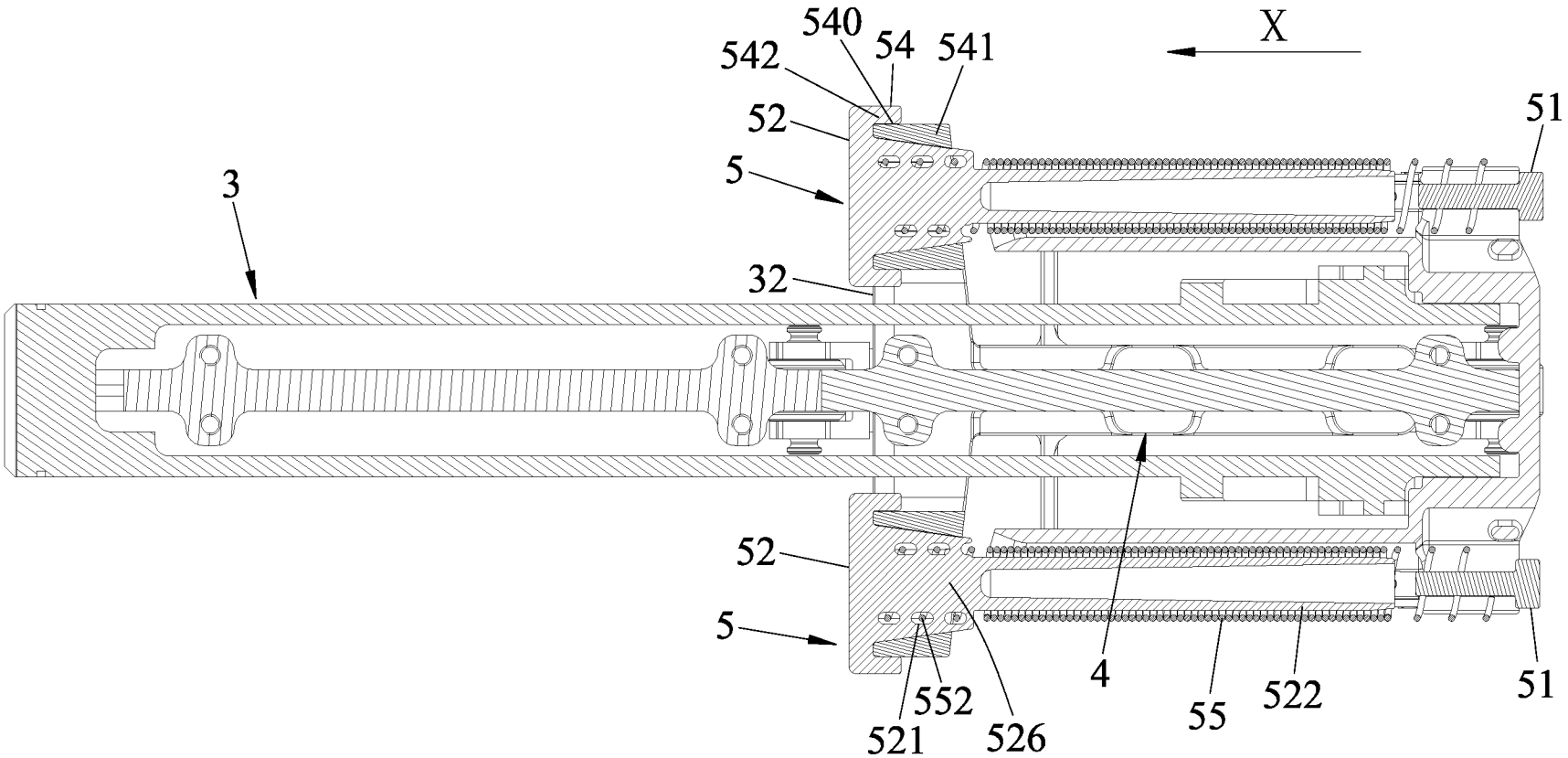
FIG. 7 is a sectional view taken along line VII-VII in FIG. 6.
Figure 8:
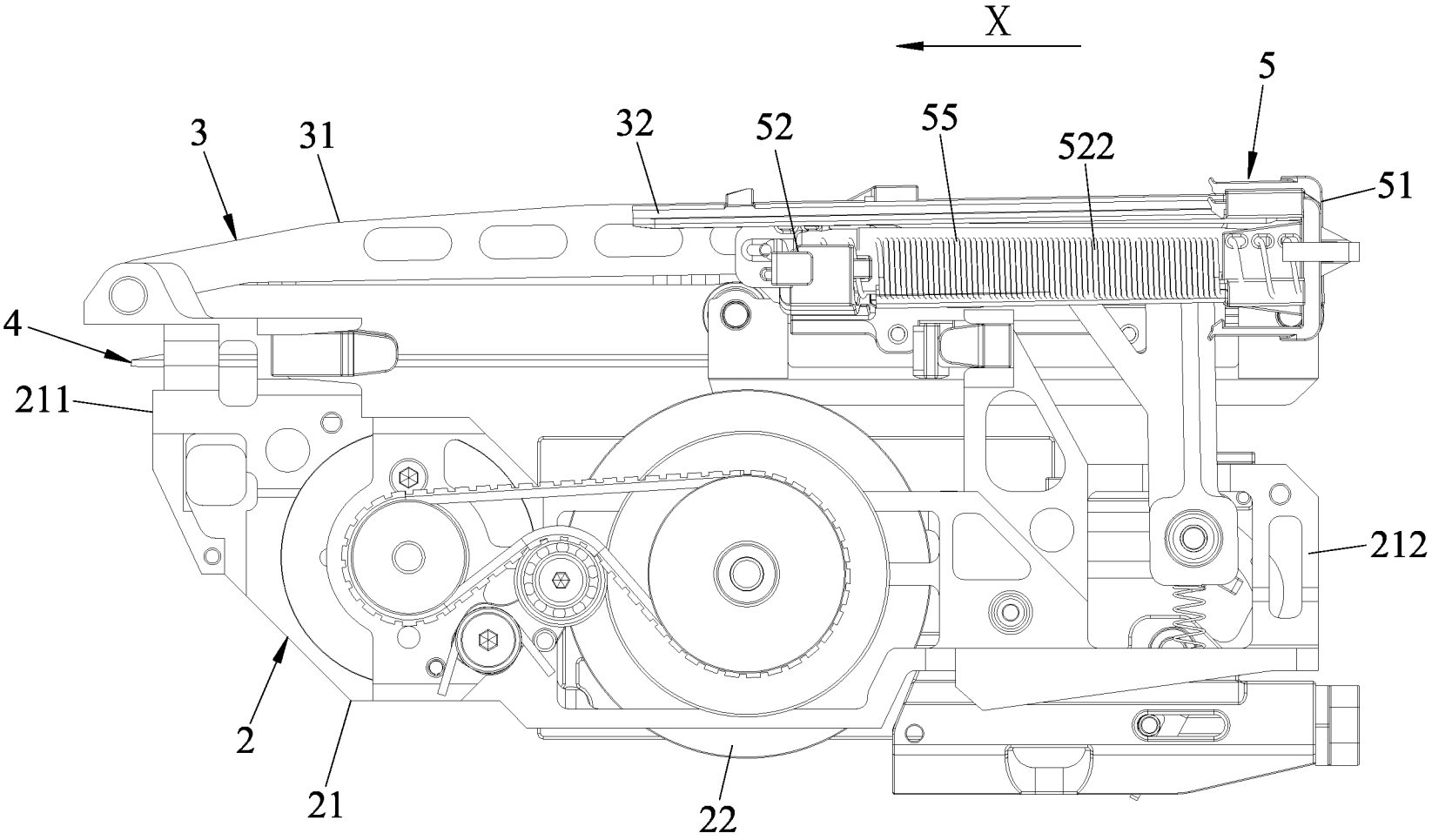
FIG. 8 is a side view of the first embodiment installed on the electric nail gun, illustrating the impact member at the standby position and a resilient member of the first embodiment not stretched.
Figure 9:
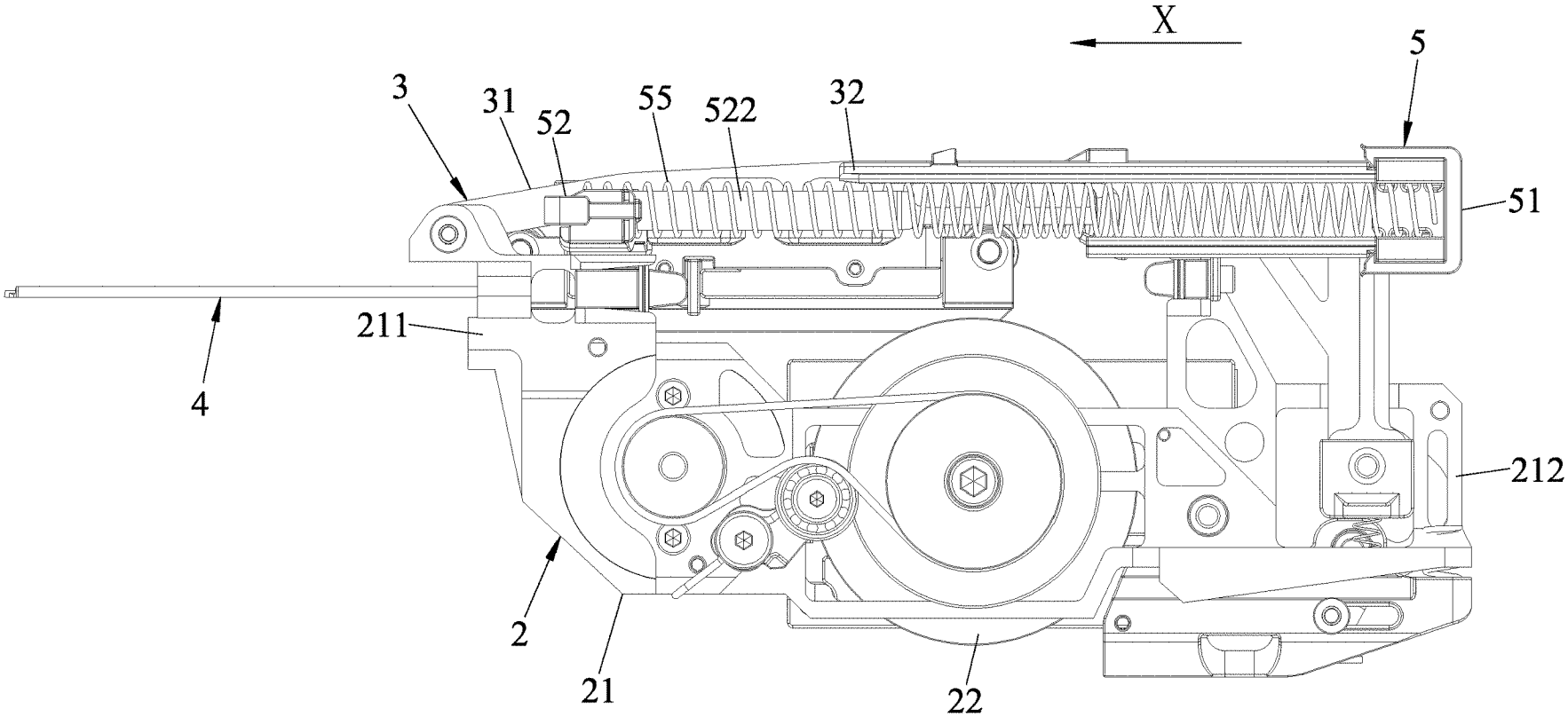
FIG. 9 is similar to FIG. 8 but illustrating the resilient member stretched and the impact member at an impact position.

Referring to FIGS. 6, 7, and 8, when the impact member 4 is not in contact with the flywheel 22, the moving seat 52 is biased by the resilient member 55 to move toward the stationary seat 51 against the length direction (X), as guided by the disposition of the guiding portion 522 in the respective receiving groove 321, so as to drive the impact member 4 to co-move therewith toward the standby position.

When the impact member 4 is in contact with the flywheel 22 to be driven by the flywheel 22, the moving seat 52 is driven to co-move with the impact member 4 in the length direction (X). The elongated moving holes 521 move relative to the second end coils 552 of the resilient member 55 before the second end coils 552 abut against an end of the elongated moving holes 521, at which point the resilient member 55 is moved in the length direction (X). The first end coils 551 of the resilient member 55 moves relative to the stationary elongated holes 511 before abutting against an end of the elongated stationary holes 551, after which the resilient member 55 is only stretched in the length direction (X). Stretching may also occur after the second end coils 552 abut against the moving elongated holes 521. An elastic restoring force accumulates in the resilient member 55 as it is stretched.

Due to the provision of the moving and stationary elongated holes 521, 511, the resilient member 55 may be displaced for a distance first before being stretched which reduces the total stretch length thereof, and an instantaneous stretch of the resilient member 55 may also be reduced, thereby allowing a uniform distribution of force on the resilient member 55.

Referring to FIG. 9, when the impact member 4 has been moved to the impact position, the resilient member 55 is stretched by the moving seat 52 to a maximum length.

When the energy driving the impact member 4 to move in the length direction (X) has depleted, the resilient member 55 may then drive the impact member 4 by the elastic restoring force stored therein to move against the length direction (X) back to the standby position, thus completing an operation cycle of the impact member 4.

Figure 10:
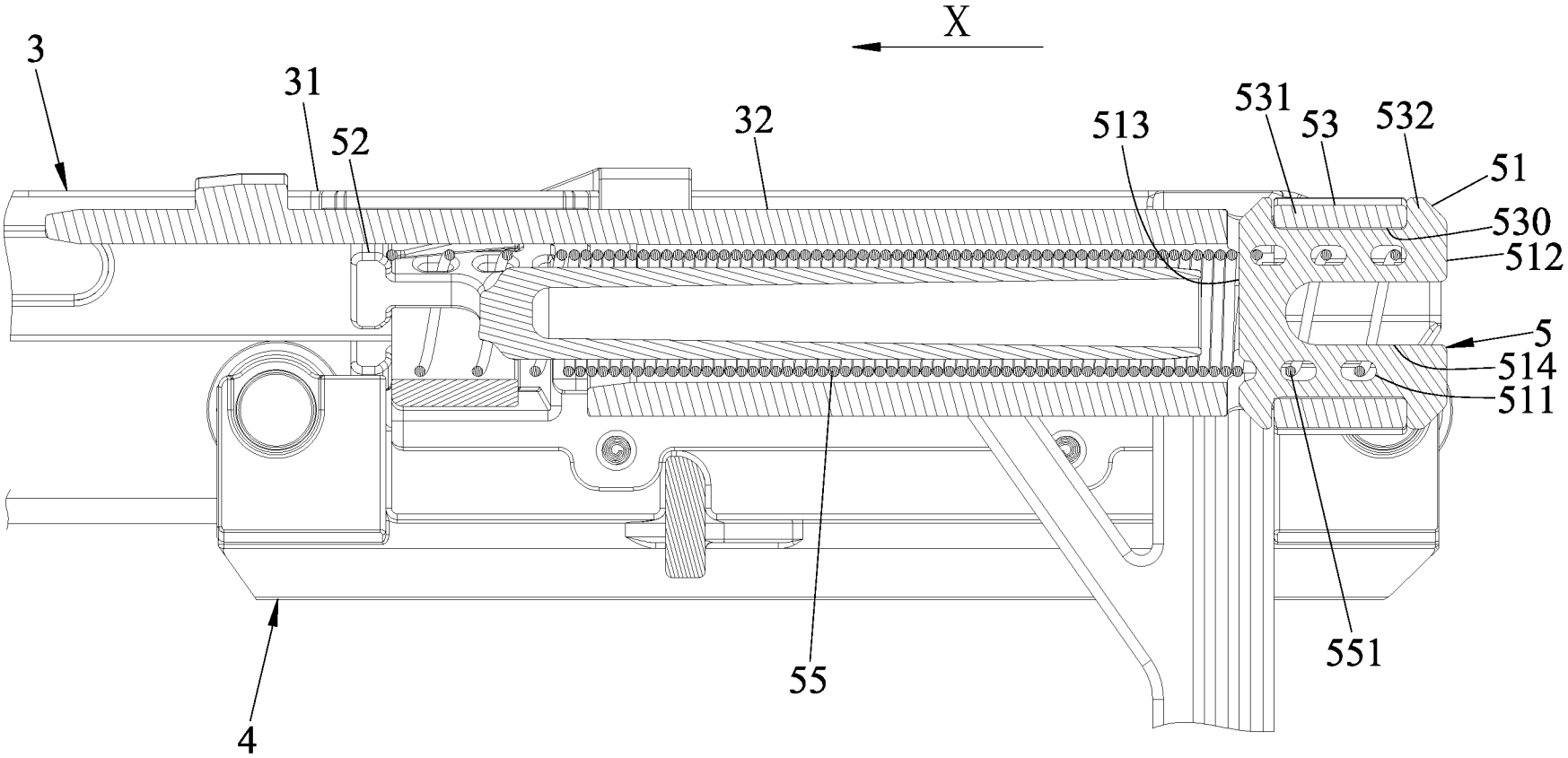
FIG. 10 is a fragmentary sectional view of a second embodiment of a striking device according to the disclosure.
Figure 11:
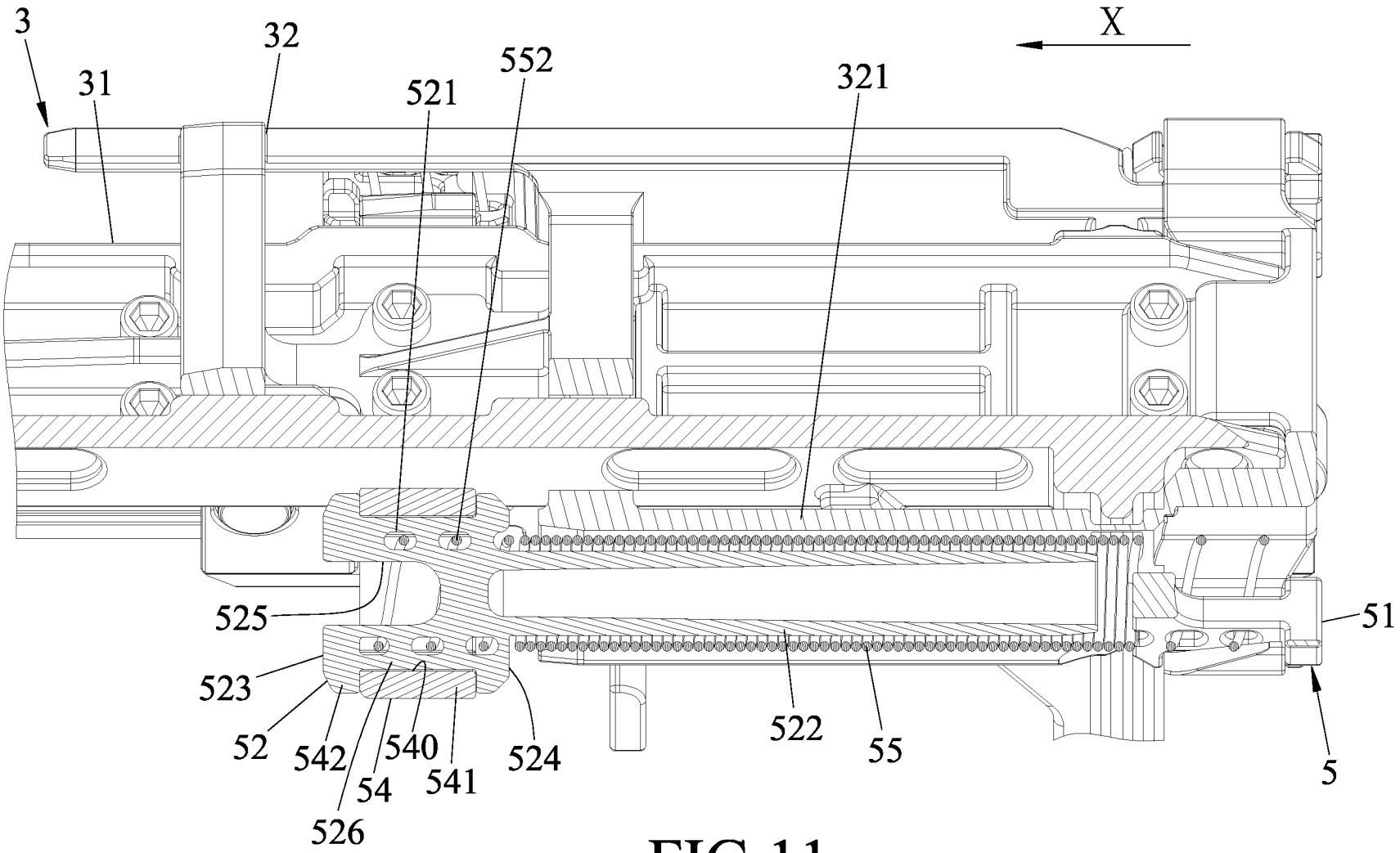
FIG. 11 is fragmentary perspective cutaway view of the second embodiment.

Referring to FIGS. 10 and 11, a second embodiment of a striking device according to the disclosure is similar to the first embodiment, and the differences therebetween are as describe below.

In the second embodiment, the stationary seat 51 has a first surface 512, a second surface 513 opposite to the first surface 512 in the length direction (X) and disposed between the first surface 512 and the moving seat 52, and a stationary groove 514 extending from the first surface 512 toward the second surface 513. Each of the first coupling portions 532 is formed with a first matching space 530 engaged with a respective one of the first matching portion 531. The first coupling portions 532 are deformable inward to shrink the stationary groove 514 of the stationary seat 51.

The moving seat 52 has a first surface 523, a second surface 524 opposite to the first surface 512 in the length direction (X) and disposed between the first surface 523 and the stationary seat 51, and a moving groove 525 extending from the first surface 523 toward the second surface 524. Each of the second coupling portions 542 is formed with a second matching space 540 engaged with a respective one of the second matching portions 541. The second coupling portions 542 are deformable inward to shrink the moving groove 525 of the moving seat 52.

To assemble the second embodiment, after the first and second end coils 551, 552 are extended correspondingly through the stationary and moving elongated holes 511, 521, the first coupling portions 532 is inserted against the length direction (X) between the first matching portions 531 until the first matching portions 531 are respectively received in the first matching spaces 530 and respectively coupled with the first coupling portions 532, then the second coupling portions 542 is inserted in the length direction (X) between the second matching portions 541 until the second matching portions 541 are respectively received in the second matching spaces 540 and respectively coupled with the second coupling portions 542.

To disassemble the second embodiment, the first coupling portions 532 are deformed so as to shrink the stationary groove 514 and decouple the first coupling portions 532 and the first matching portions 531, then the second coupling portions 542 are deformed so as to shrink the moving groove 525 and decouple the second coupling portions 542 and the second matching portions 541. Then, the stationary seat 51 and the moving seat 52 may be detached from the loading frame 32 and the impact member 4, respectively, for repair or to replace the resilient member 55.

Figure 12:
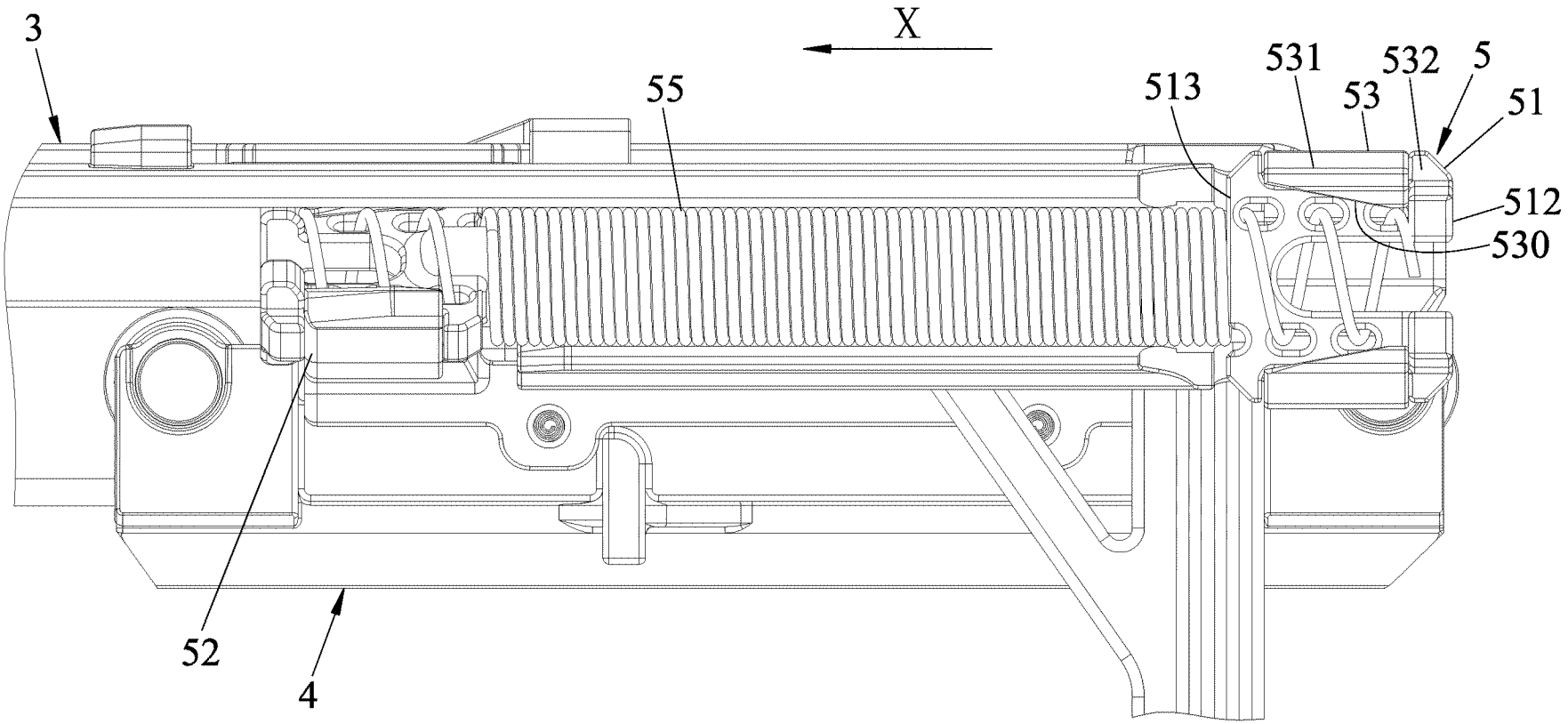
FIG. 12 is a fragmentary side view of a variation of the second embodiment.
Figure 13:
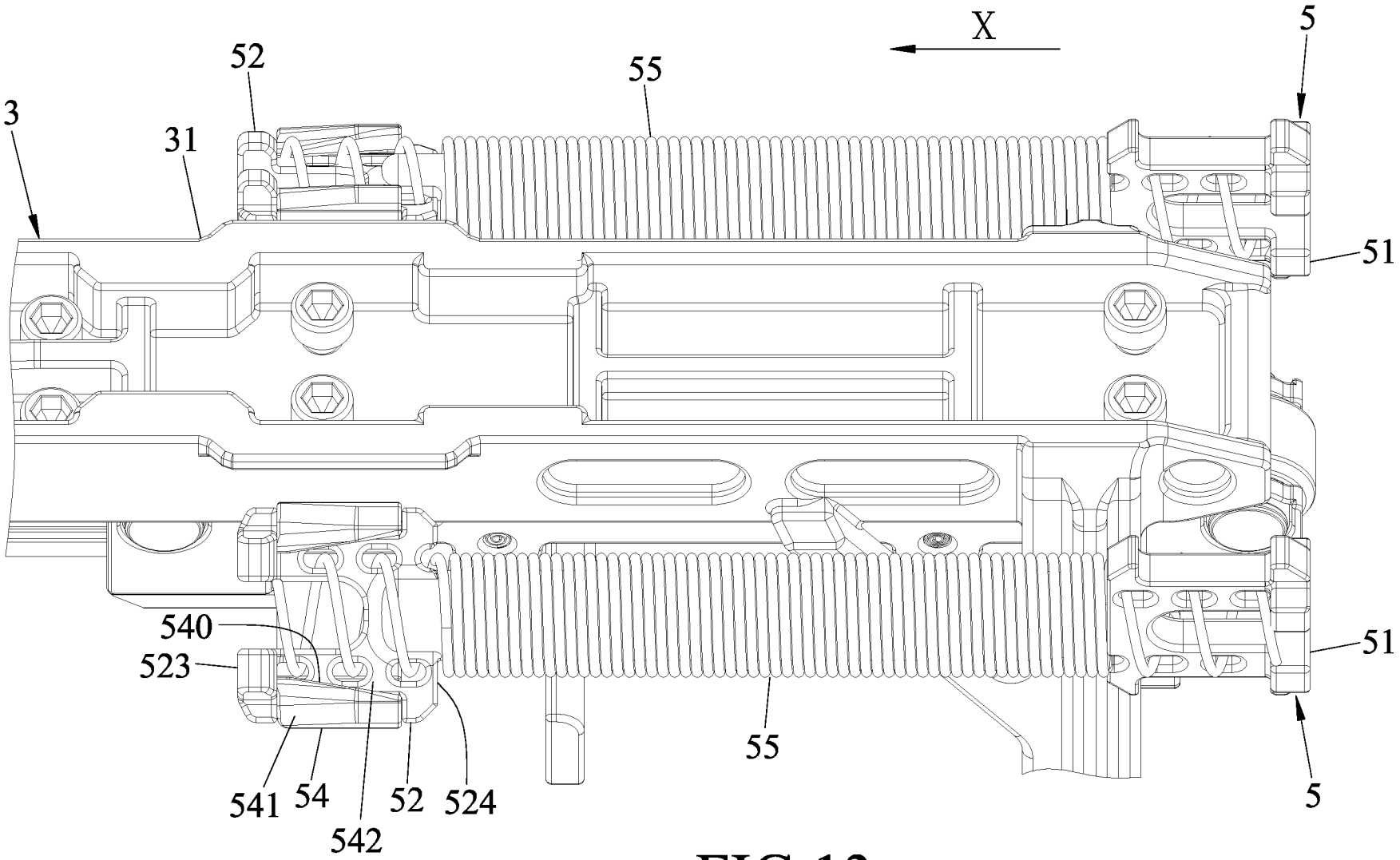
FIG. 13 is a fragmentary perspective view of another variation of the second embodiment.

It should be noted that the stationary seat 51, the moving seat 52, and the first and second coupling sets 53, 54 may be substantially cylindrical, or be substantially flat. In the second embodiment, as shown in FIGS. 10 and 11, each of the first and second matching spaces 530, 540 have a constant depth, but is not limited thus. In variations of the second embodiment, as shown in FIGS. 12 and 13, the first matching space 530 may have a depth which decreases from an end proximal to the first surface 512 of the stationary seat 51 to an end proximal to the second surface 513 of the stationary seat 51, and/or the second matching space 540 may have a depth which decreases from an end proximal to the first surface 523 of the moving seat 52 to an end proximal to the second surface 524 of the moving seat 52. This configuration facilitates smoother removal of the stationary seat 51 from the loading frame 32 and the moving seat 52 from the impact member 4.

Figure 14:
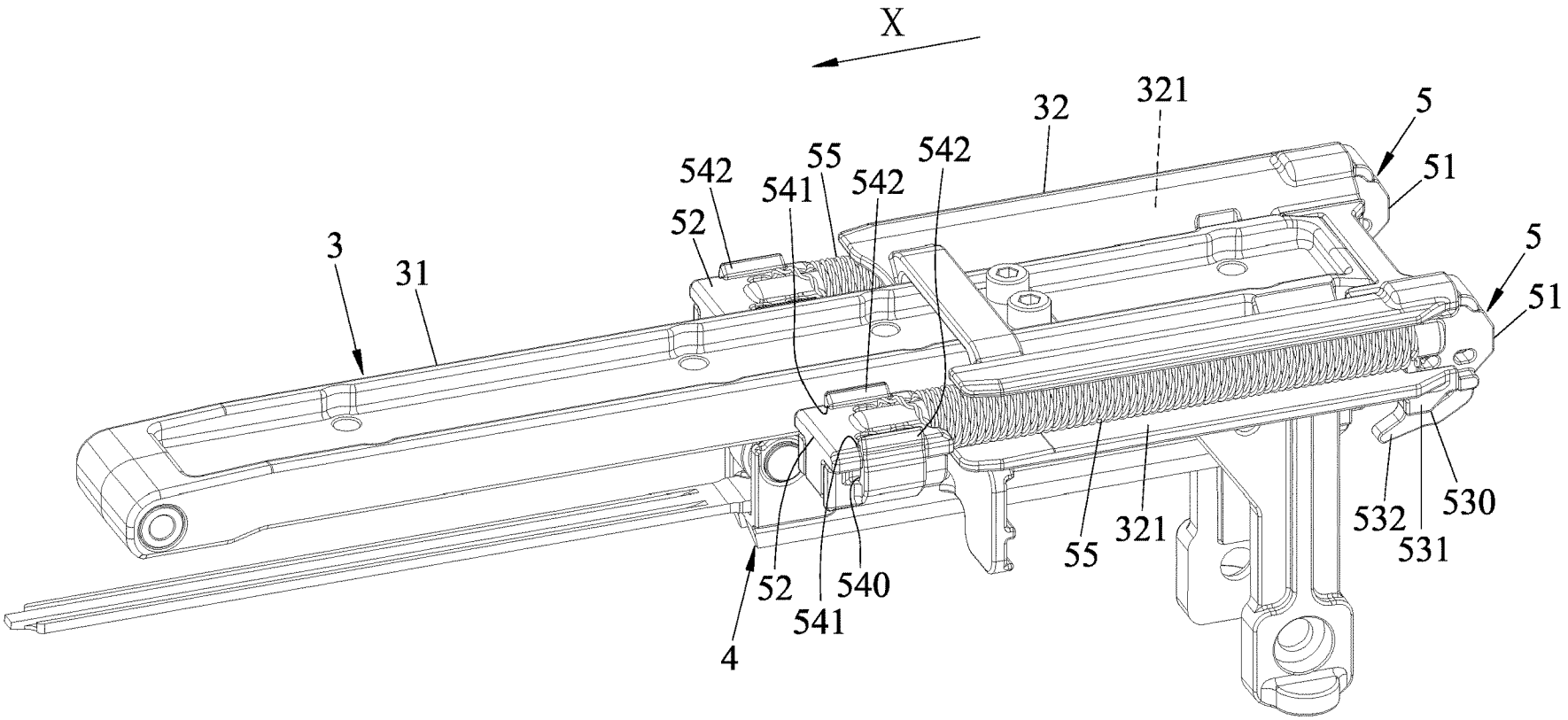
FIG. 14 is a perspective view of a third embodiment of a striking device according to the disclosure.
Figure 15:
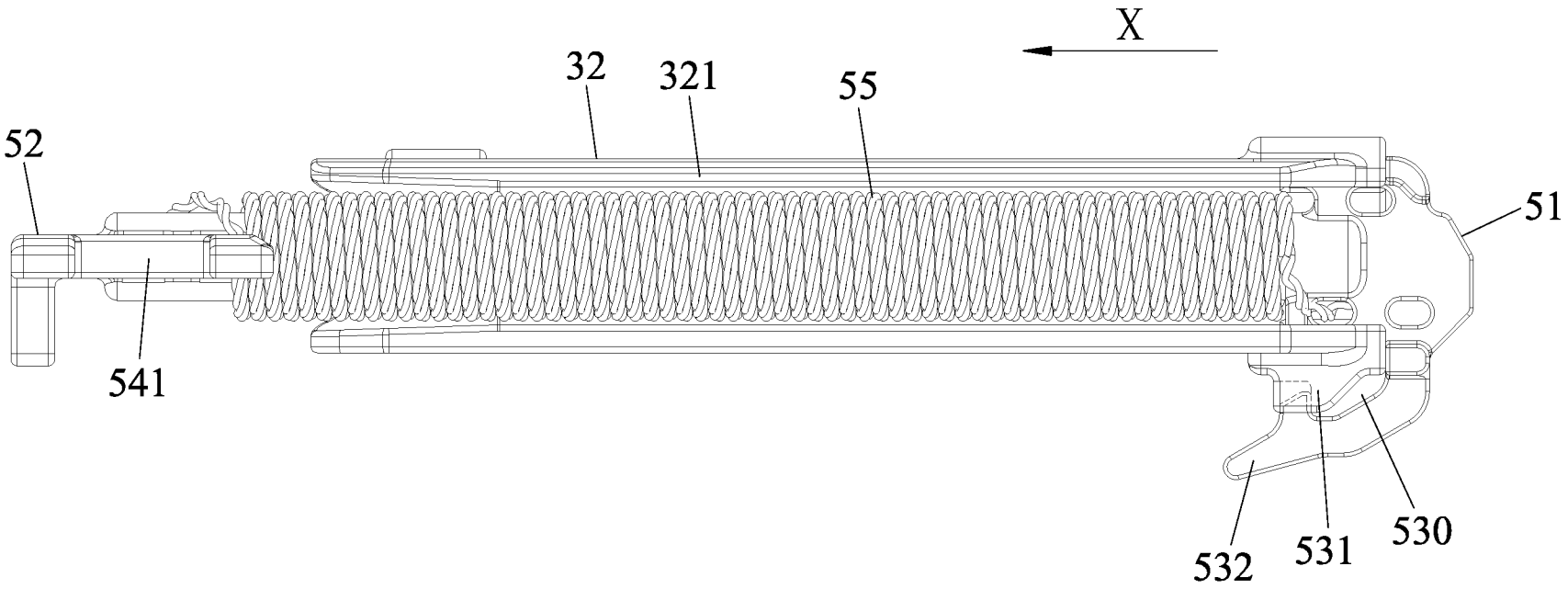
FIG. 15 is a fragmentary side view of the third embodiment.

Referring to FIGS. 14 and 15, a third embodiment of a striking device according to the disclosure is similar to the first embodiment, and the differences therebetween are described below.

In the third embodiment, the at least one first matching portion 531 has one first matching portion 531 formed on the swing arm unit 3, and the at least one first coupling portion 532 has one first coupling portion 532 disposed on the stationary seat 51 and cooperatively defining with the stationary seat 51 a first matching space 530 that is engaged with the first matching portion 531. The first coupling portion 532 is deformable outward to expand the first matching space 534.

The at least one second matching portion 541 has two second matching portions 541 formed on the moving seat 52 and spaced apart from each other, and the at least one second coupling portion 542 has two second coupling portions 542 disposed on the impact member 4. The second coupling portions 542 define therebetween the second matching space 540 that is engaged with the moving seat 52. Each of the second matching portions 541 is an indentation into the moving seat 52 and receives a respective one of the second coupling portions 542. The second coupling portions 542 are deformable outward to expand the second matching space 540.

To assemble the third embodiment, after the resilient member 55 engages the stationary and moving seats 51, 52, the first coupling portion 532 is placed to the rear of the first matching portion 531 and pushed in the length direction (X) until the first matching portion 531 is received in the first matching space 530 and coupled with the first coupling portion 532. Then, the moving seat 52 is pushed downward in between the second coupling portions 542 so as to be received in the second matching space 540 and so that the second matching portions 541 respectively receive the second coupling portions 542 and is coupled to the moving seat 52.

To disassemble the third embodiment, the first coupling portion 532 is deformed outward so as to expand the first matching space 530 and decouple the first coupling portion 532 and the first matching portion 531, and the second coupling portions 542 are deformed outward to expand the second matching space 540 and decouple the second coupling portions 542 and the second matching portions 541. Then, the stationary seat 51 and the moving seat 52 maybe detached from the loading frame 32 and the impact member 4, respectively, for repair or to replace the resilient member 55.

The benefits of embodiments are as follows:

1. Due to the provision of the stationary elongated holes 511 elongated in the length direction (X), when the resilient member 55 is moved in the length direction (X), the first end coils 551 may move in the stationary elongated holes 511 to reduce the instantaneous stretch of the resilient member 55, thereby increasing the service life of the resilient member 55.

2. Due to the provision of the stationary elongated holes 511 and the moving elongated holes 521 and the fact that the stationary and moving seats 51, 52 are connected by the resilient member 55, a maximum distance between the stationary and moving seats 51, 52 may be achieved with a reduced total stretch of the resilient member 55 when compared to a configuration without the stationary and moving elongated holes 511, 512, thereby allowing a uniform distribution of force on the resilient member 55 and smoother movement.

3. During manufacturing, portions of the restoring unit 5 apart from the second matching portions 541 (i.e. the portion of the second coupling set 53 formed on the impact member 4) may be manufactured modularly along with the loading frame 32, then fixed to the swing arm 31 and coupled with the impact member 4 through the second matching portions 541. This makes manufacture of the striking device more precise and efficient 4. Due to the provision of the first and second coupling sets 53, 54, the stationary and moving seats 51, 52 may be coupled and decoupled to be quickly assembled on or disassembled from the swing arm unit 3 and the impact member 4, thereby making assembly and repair of the restoring unit 5, and replacement of the resilient member 55 easy.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A striking device adapted to be installed in an electric nail gun, the electric nail gun including a main frame and a flywheel that is rotatably mounted to the main frame, said striking device comprising:

a swing arm unit adapted to be pivotally mounted to the main frame and adapted to swing relative to the flywheel;

an impact member slidably connected to said swing arm unit and adapted to be driven by the flywheel to move in a length direction; and two restoring units each including a stationary seat that is removably connected to said swing arm unit, a moving seat that is removably and co-movably connected to said impact member, first and second coupling sets, and a resilient member that interconnects said stationary seat and said moving seat to bias said moving seat toward said stationary seat;

wherein, for each of said restoring units, said first coupling set includes at least one first matching portion formed on one of said stationary seat and said swing arm unit, and at least one first coupling portion formed on the other one of said stationary seat and said swing arm unit and coupled removably with said at least one first matching portion;

wherein, for each of said restoring units, said second coupling set includes at least one second matching portion formed on one of said impact member and said moving seat, and at least one second coupling portion formed on the other one of said impact member and said moving seat and coupled removably and co-movably with said at least one second matching portion;

wherein, for each of said restoring units, said stationary seat has a plurality of stationary elongated holes elongated in the length direction;

wherein, for each of said restoring units, said moving seat has a plurality of moving elongated holes elongated in the length direction;

wherein, for each of said restoring units, said resilient member has opposite first and second end coils, said first end coils extending movably through said stationary elongated holes, said second end coils extending movably through said moving elongated holes;

wherein, for each of said restoring units, said moving seat includes a main portion formed with said moving elongated holes, and a guiding portion connected to said main portion and being elongated in the length direction, said resilient member further having intermediate coils that interconnect said first and second end coils and that are sleeved on said guiding portion of said moving seat;

wherein said swing arm unit includes a swing arm adapted to be pivotally mounted to the main frame, and a loading frame mounted to said swing arm and having two receiving grooves that are disposed respectively on opposite lateral sides thereof and that open outward, said resilient members of said restoring units are respectively received in said receiving grooves; and wherein, for each of said restoring units, said at least one first matching portion of said first coupling set is formed on one of said stationary seat and said loading frame, and said at least one first coupling portion of said first coupling set is formed on the other one of said stationary seat and said loading frame.

2. The striking device as claimed in claim 1, wherein, for each of said restoring units, said stationary elongated holes of said stationary seat are arranged into two non-collinear rows each extending in the length direction, and said moving elongated holes of said moving seat are arranged into two non-collinear rows each extending in the length direction.

3. The striking device as claimed in claim 1, wherein, for each of said restoring unit:

said stationary seat has a first surface, a second surface opposite to said first surface in the length direction and disposed between said first surface and said moving seat, and a stationary groove extending from said first surface toward said second surface;

said at least one first matching portion has two first matching portions formed on said loading frame and spaced apart from each other; and said at least one first coupling portion has two first coupling portions disposed respectively on opposite sides of said stationary seat and being deformable inward to shrink said stationary groove of said stationary seat, each of said first coupling portions being formed with a first matching space that is engaged with a respective one of said first matching portions.

4. The striking device as claimed in claim 3, wherein, for each of said restoring unit, each first matching space has a depth which decreases from an end proximal to said first surface of said stationary seat to an end proximal to said second surface of said stationary seat.

5. The striking device as claimed in claim 1, wherein, for each of said restoring unit:

said at least one first matching portion has two first matching portions formed on said loading frame and spaced apart from each other; and said at least one first coupling portion has two first coupling portions disposed respectively on two sides of said stationary seat, each of said first coupling portions cooperatively defining with said stationary seat a first matching space that opens toward said moving seat and that is engaged with a respective one of said first matching portions, each of said first coupling portions being deformable outward to expand a respective one of said first matching spaces.

6. The striking device as claimed in claim 5, wherein, for each of said restoring unit, each first matching space has a width which increases in the length direction toward said moving seat.

7. The striking device as claimed in claim 1, wherein, for each of said restoring unit:

said at least one first matching portion has one first matching portion formed on said loading frame;

said at least one first coupling portion has one first coupling portion disposed on said stationary seat and cooperatively defining with said stationary seat a first matching space that is engaged with said first matching portion; and said first coupling portion is deformable outward to expand said first matching space.

8. The striking device as claimed in claim 1, wherein, for each of said restoring unit:

said moving seat has a first surface, a second surface opposite to said first surface in the length direction and disposed between said first surface and said stationary seat, and a moving groove extending from said first surface toward said second surface;

said at least one second matching portion has two second matching portions formed on said impact member and spaced apart from each other; and said at least one second coupling portion has two second coupling portions disposed respectively on opposite sides of said moving seat and being deformable inward to shrink said moving groove of said moving seat, each of said second coupling portions being formed with a second matching space that is engaged with a respective one of said second matching portions.

9. The striking device as claimed in claim 8, wherein, for each of said restoring unit, each second matching space has a depth which decreases from an end proximal to said first surface of said moving seat to an end proximal to said second surface of said moving seat.

10. The striking device as claimed in claim 1, wherein, for each of said restoring unit:

said at least one second matching portion has two second matching portions formed on said impact member and spaced apart from each other; and said at least one second coupling portion has two second coupling portions disposed respectively on two sides of said moving seat, each of said second coupling portions defining cooperatively with said moving seat a second matching space that opens toward said stationary seat and that is engaged with a respective one of said second matching portions, each of said second coupling portions being deformable outward to expand a respective one of said second matching spaces.

11. The striking device as claimed in claim 10, wherein, for each of said restoring unit, each second matching space has a width which decreases in the length direction away from said stationary seat.

12. The striking device as claimed in claim 1, wherein, for each of said restoring unit:

said at least one second matching portion has two second matching portions formed on said moving seat and spaced apart from each other; and said at least one second coupling portion has two second coupling portions disposed on said impact member, said second coupling portions defining therebetween a second matching space that is engaged with said moving seat, each of said second matching portions being an indentation into said moving seat and receiving a respective one of said second coupling portions, said second coupling portions being deformable outward to expand said second matching space.

* * * * *